US008534363B1

(12) United States Patent
Tseytlin et al.

(10) Patent No.: US 8,534,363 B1
(45) Date of Patent: Sep. 17, 2013

(54) METHODS AND DEVICES FOR RESTORING CONTROL AND RESUMING PRODUCTION AT AN OFFSHORE OIL WELL FOLLOWING AN UNCONTROLLED FLUID RELEASE AFTER AN EXPLOSION

(71) Applicants: Simon Tseytlin, Middle Village, NY (US); David Tseytlin, Brooklyn, NY (US)

(72) Inventors: Simon Tseytlin, Middle Village, NY (US); David Tseytlin, Brooklyn, NY (US)

( * ) Notice: Subject to any disclaimer, the term of this patent is extended or adjusted under 35 U.S.C. 154(b) by 0 days.

(21) Appl. No.: 13/897,435

(22) Filed: May 19, 2013

Related U.S. Application Data

(63) Continuation-in-part of application No. 13/184,497, filed on Jul. 16, 2011, now Pat. No. 8,448,709, and a continuation-in-part of application No. 13/675,915, filed on Nov. 13, 2012, now Pat. No. 8,474,536.

(60) Provisional application No. 61/681,257, filed on Aug. 9, 2012, provisional application No. 61/367,478, filed on Jul. 26, 2010.

(51) Int. Cl.
*E21B 7/12* (2006.01)

(52) U.S. Cl.
USPC ..... 166/335; 166/339; 166/345; 166/363; 166/364

(58) Field of Classification Search
USPC ..... 166/363, 339, 364, 368, 285, 381, 166/386, 387, 75.15, 179, 192, 193; 138/89
See application file for complete search history.

(56) References Cited

U.S. PATENT DOCUMENTS

| | | | | |
|---|---|---|---|---|
| 4,324,505 | A * | 4/1982 | Hammett | 405/60 |
| 7,513,309 | B2 * | 4/2009 | Ruttley et al. | 166/341 |
| 8,205,677 | B1 * | 6/2012 | Salkin | 166/363 |
| 8,474,543 | B2 * | 7/2013 | Kotefski et al. | 166/386 |
| 2011/0303416 | A1 * | 12/2011 | Herman, II | 166/350 |
| 2012/0018174 | A1 | 1/2012 | Kotefski | |
| 2012/0273213 | A1 | 11/2012 | Blalock | |

* cited by examiner

*Primary Examiner* — Matthew Buck
*Assistant Examiner* — James Sayre
(74) *Attorney, Agent, or Firm* — Boris Leschinsky

(57) ABSTRACT

Methods and devices for restoring control of at an offshore oil well following an uncontrolled fluid release after an explosion include lowering through a riser of successive flow restricting inserts into the oil well to gradually reduce the uncontrolled fluid release. Flow restricting inserts may be inserted in parallel or in series with each other. Following attachment of the riser to the oil well, provisions are made to restore oil production from the well. Flow restricting inserts may further be used to adjust flow resistance from the well in order to optimize oil production. Passages between the riser and the flow restricting inserts may also be used to form a gas lift in order to maximize production of oil from the well.

20 Claims, 10 Drawing Sheets

METHODS AND DEVICES FOR RESTORING CONTROL AND RESUMING PRODUCTION AT AN OFFSHORE OIL WELL FOLLOWING AN UNCONTROLLED FLUID RELEASE AFTER AN EXPLOSION

CROSS-REFERENCE DATA

This application is a continuation-in-part of the co-pending U.S. patent application Ser. No. 13/675,975 filed 13 Nov. 2012 entitled "Method and Alignment System for Killing an Uncontrolled Oil-Gas Fountain at an Offshore Oil Platform Using a Telescopic Insert Assembly"; which in turn claims the priority date benefit from a U.S. Provisional Application No. 61/681,257 filed 9 Aug. 2012 and entitled "The Method of Killing an Uncontrolled Oil-Gas Fountain at an Offshore Oil Platform Using a Telescopic Insert Assembly".

This application is also a continuation-in-part of the U.S. patent application Ser. No. 13/184,497 filed 16 Jul. 2011, now U.S. Pat. No. 8,448,709 entitled "Method of Killing an Uncontrolled Oil-Gas Fountain Appeared After an Explosion of an Offshore Oil Platform"; which in turn claims a priority benefit of the U.S. Provisional Patent Application No. 61/367,478 filed 26 Jul. 2010.

All cited above patent documents are incorporated herein in their respective entireties by reference.

BACKGROUND

The present invention relates to methods and devices for regaining control and resuming oil and/or gas production at an offshore oil well after an explosion or a blowout causing an uncontrolled release of fluids such as oil or water mixed with gas from the remaining part of the damaged well. The term "oil well" is used herein to describe a well that produces any type of hydrocarbons including oil and gas, but which may also produce a gas condensate or water as part of the multiphase fluid discharge that comes out of the well. The present invention more specifically relates to methods for controlling the fluid discharge by gradually decreasing fluid flow using a plurality of flow restricting inserts.

In the field of offshore oil drilling, oil wells are kept under control by means of a column of mud which provides a hydrostatic load sufficient for maintaining overpressure between the well and the external pressure at control values. This column of mud, also known as primary well control barrier, is present both inside the well and also in a pipe called a riser, which connects the drilling platform at the sea surface to the sea bottom.

At the sea bottom, moreover, in correspondence with the well heads, there are present secondary oil well control devices, called blowout preventers (BOP) configured as valves to close the oil well off in the case of uncontrolled release of fluids from the well itself.

Often during drilling or well exploration in gas and oil wells, a gas kick may enter into the well space. Such gas may come from the well reservoir (formation) and reach the bottom hole of the well. If this is not detected immediately, a gas bubble (gas kick) is created in the hole. Gas kick, according to Archimedes' principle begins to ascend within the annular space of the well. If not allowed to expand, such gas kick brings its initial high pressure equal to the formation pressure to the head of the well. At the same time, the pressure everywhere along the well begins to rise. If the BOP is closed, and there is no "washing" in the well, a hydrofracture of formation may occur. As a result, the drilling fluid enters the formation, and the well is filled with gas. If the drill pipe has no check valve, the gas also fills drill pipes all the way up to the wellhead. This may cause a gas explosion that may result in human casualties, environmental pollution and the creation of an uncontrolled fountain. This uncontrolled fountain is very difficult to suppress, because the wellhead is under enormous pressure. As offshore drilling on the continental shelves is progressing into deeper and deeper waters, the problem is many times more complicated when the explosion occurs in deep waters. Suppressing such a well and cleaning of the environment may cost billions of dollars.

Presently known are various techniques for reestablishing the control of the well in case of a blowout, such as for example the techniques of bridging, capping, production of a relief well and assembling a string of pipes for the injecting cement down the well, such string is sometimes referred to as a killing string.

A killing intervention consists of the insertion of a specific string of pipes inside a blowout well. When inserted in the well, the killing string allows conventional killing techniques to be applied such as the circulation of heavy mud, closure by means of inflatable packers, and so forth. This method has proved to be the most rapid, but it can currently only be used in the case of well blowouts in shallow water, i.e. less than 1,000 meters deep. In addition, in order to allow for the adequate flow of cement through the killing string, its internal diameter has to be sufficiently large such as at least 10 cm or more. Inserting such a large string of pipes presents a challenge due to an enormous pressure in the well urging the killing string out of the well. Additional methods of killing a well include drilling a side channel into the well and sealing the well through such channel. This method takes a long time (several months) while allowing for the uncontrolled release to continue polluting the waters with large quantity of oil. This process is also quite expensive. In addition, there is always an uncertainty present as to the exact location of the well deep down under the sea bottom. On occasion, if the side channel has missed the well, a powerful explosion may have to be used to shift the layers of the rocks and the ground near the well so as to seal it properly. In rare circumstances, underground nuclear explosions are known to be used for such purpose.

To date, no practical equipment or method is available to the industry for the purpose of regaining control of a deep water abandoned wellhead on the offshore seabed after a blowout causing spilling of reservoir fluids into the sea. The environmental pollution caused by such outpouring of reservoir fluids and gases can have disastrous consequences, as evident by the 2011 pollution created over a large section of the Gulf of Mexico and adjacent beaches by the erupted BP well off the coast of Mexico.

There is a need for improved and expeditious methods for regaining control of an uncontrolled release of fluids from an oil well following a blowout or an explosion event.

There is also a need preserve the oil well and to resume oil production therefrom following an explosion. Drilling a single underwater oil well costs millions of dollars and so it is highly desirable to not abandon a well if at all possible so as not to suffer an economic loss associated with such abandonment.

SUMMARY OF THE INVENTION

The object of the present invention is to provide improved methods and devices for restoring control of an oil well and arresting uncontrolled release of fluids into the environment following an explosion.

Another object of the present invention is to provide novel methods and devices for efficient, expedient, and less expensive processes of regaining control over an oil well after a blowout or an explosion.

A further object of the invention is to provide novel methods and devices for continuing production of oil from an oil well following an accidental explosion.

Another yet object of the present invention is to provide methods and devices for gradual flow adjustment in oil production over a broad range of operating parameters after regaining control over the well following an explosion. Such adjustments are needed to optimize oil production from the well over the remaining lifetime thereof.

Novel methods of the invention broadly include steps of inserting a series of flow-restricting inserts into the oil well aimed to gradually reduce the uncontrolled fluid release therefrom. Once the flow of fluids is reduced to a predetermined level, the riser may be attached to the end of the oil well so that any further fluid release may be captured at the sea surface.

In addition to quickly restoring control over the damaged oil well, the present invention provides for novel methods and devices to return the well to produce oil through the riser. In fact, additional manipulation of the flow restricting inserts (lowering or rising at least some of them or adding/removing more inserts) provides for a convenient way to adjust flow production from the oil well for the remaining portion of the well lifespan.

Describing the invention now in more detail, flow restricting inserts of the invention may include a series of solid rods or hollow pipes, which may be attached or inserted one into another. Initially, a first flow restricting insert (such as a solid rod) may be inserted into the opening of the oil well. As diameter of the first insert is selected to be smaller than the oil well opening, the force urging the insert out of the well may not be as high—since fluids are still flowing out of the well around the first insert. The material, length and size of the first insert may be selected such that its weight exceeds the force urging it out of the well. In that case, the first insert may be lowered into the well using its weight and not requiring any additional lowering force to be applied from above.

Once the first insert enters the well, the fluid release will be somewhat diminished. The deeper the first insert goes, the greater is this reduction.

Additional flow restricting inserts may then be inserted into the well following placement of the first insert. In embodiments, such additional inserts may be inserted in parallel with the first insert. In other embodiments, additional flow restricting inserts may be inserted to form concentric telescopic assembly with the first insert. The number, size and length of the additional inserts may be selected depending on the depth of the well and the level of fluid pressure therein. Proper selection of additional inserts may be done using a condition of inserting of each successive insert when its own weight may be sufficient to overcome the forces urging the insert out of the oil well.

Fluid release will be further diminished as a result of positioning additional flow restricting inserts into the oil well. Once the flow of fluids is reduced to a manageable level, the riser may be attached to the oil well to preclude further fluid release therefrom. At this point, the oil well may be sealed off, for example by pumping cement down the annular space between the riser and the biggest flow restricting insert. In other embodiments, the oil production from the oil well may be resumed. In this case, the presence of flow restricting inserts allows for an advantageous adjustment of flow resistance through the riser over the remaining portion of the oil well lifespan.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF THE PREFERRED EMBODIMENTS OF THE INVENTION

Figure 1:
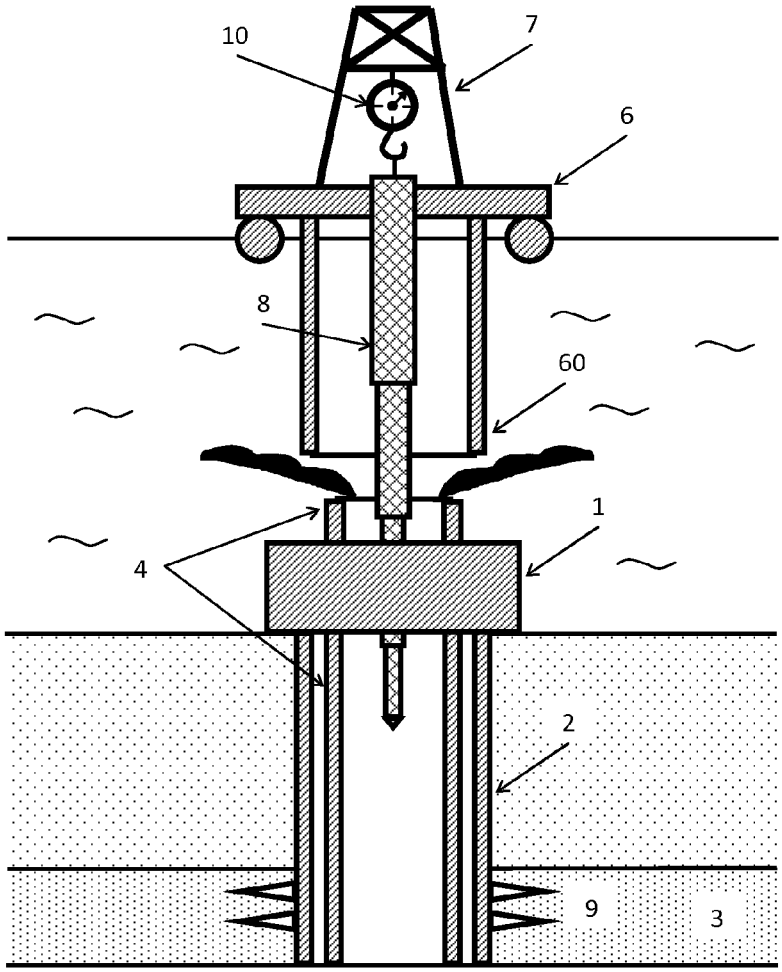
FIG. 1 is general depiction of the components involved in practicing the method of the invention.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

A general illustration of the elements needed to practice the invention is shown in FIG. 1. Seen in this illustration is a sea platform or a ship 6 supporting a rig 7. The platform 6 has a riser 60 extending therefrom and ending above the opening of the oil well casing 2. Hanging down from the rig 7 (via an optional weight balance 10) and extending through the riser 60 is a flow restricting assembly 8 seen in FIG. 1 as entering the pipe 4 of the oil well casing 2. The pipe 4 is assumed to extend from the sea bottom into formation 3 so as oil and other fluids may be produced through perforations 9.

Also shown is a BOP 1, which may or may not still be present at the oil well casing 2 after the explosion. The method of the invention works in both cases: when the BOP remains on the well as well as when BOP is missing and only a small section of pipe remains in place. In this case, to prepare the pipe for the method of the invention, its top portion may be cut normal to the axis of the pipe leaving a short pipe section extending from the sea bottom.

The present invention further works if the well is not yet fully constructed, such as the case when the blowout occurred during drilling. The term "oil well" in that case is used herein to describe a drill pipe, which may still remain in place after the explosion.

At the beginning of the procedure, the lower end of the riser 60 may be positioned above and aligned with the BOP or the remaining opening of the oil well. The method of the invention includes successive placement through the riser 60 of flow restricting inserts down the well pipe 4 in order to gradually reduce the flow of fluid release. Several different types of flow restricting inserts forming the flow restricting assembly 8 are contemplated to be within the scope of the present invention. Such inserts may be round, oval or have differently shaped cross-sections. They may be solid or hollow and sized to accept smaller inserts therein.

In embodiments, flow restricting inserts may be successively placed into the oil well one at a time—either next to each other or over each other, or as a combination of both next to each other and over each other.

In embodiments, the length of at least some of flow restricting inserts may be selected to partially or fully span the length of the pipe 4 between the sea bottom and the well bottom (or the bottom of an oil reservoir formation 3). In other embodiments, the length of the flow restricting inserts may be selected to be longer, in some cases as long as to reach the sea surface after the insert is placed in the oil well. The advantage of suspending and maintaining individual inserts from the sea surface and down at least partially the depth of the well is that in this case, individual flow restricting inserts may be selectively lowered, raised, or removed altogether from the riser and the oil well, which may be used in adjusting flow resistance from the oil well to maximize oil production or for other purposes.

In embodiments, the material of the flow restricting inserts may be metal such as steel, or another material appropriate for the oil well environment. The cross-sectional area and the material for each individual flow restricting insert may be selected depending on the oil well pressure, reservoir depth, sea depth and other factors. The guiding principle behind selecting the material, length and cross-sectional area for each flow restricting insert is to assure that its respective weight is at least even or greater than the level of force urging the insert out of the well. This is necessary to assure that the insert can be lowered into the well based on its own force of gravity so as no additional pushing force may be needed to place the insert into the well.

In embodiments, the flow restricting inserts may have a constant or varying cross-sectional shape or size along its length. In the most basic case, the flow restricting insert may be a steel insert of constant diameter. In other embodiments, flow restricting inserts may be metal pipes, which may be sized for example to be placed one inside the other. In yet other embodiments, flow restricting inserts may be shaped as a single telescopic insert assembly as discussed in more detail in our cited prior patent applications.

In embodiments, flow restricting inserts may have threaded ends adapted for attachment to other inserts or other end design as described in more detail below. The diameter of each insert may be from 10 mm to 800 mm. Importantly, the size of the final insert should match as closely as possible the inner diameter of the well pipe 4. If large diameters are required, materials other than steel may be used for large diameter inserts to reduce its weight. Alternatively, such large diameter inserts may be made of pipes with inside opening diameter selected appropriately to reduce the weight as needed.

The initial insert may be selected to have a small enough diameter so as to enter the opening of the well pipe 4 without much resistance. Considering that the weight of such insert may reach several hundred kilograms since the depth of a well is significant, little or no resistance should be encountered upon entrance of the first flow restricting insert into the oil well. Note that the entrance of the tip of the first insert may be aided by centering thereof using known means as for example described in our previously cited patent applications.

Once the first insert is placed in the well, additional inserts may be placed to gradually increase the overall cross-sectional area of the inserts and decrease the space inside the oil well available for fluid release. Reduced fluid release is a result of both the reduction of available cross-sectional area as well as an increase of flow friction between the inside surface of the well and the flow restricting inserts.

It is important to properly select flow restricting inserts to assure their smooth entrance into the oil well. One useful method of monitoring the progress of lowering flow restricting inserts into the well may include using a weight balance 10 positioned at the sea surface. Monitored force in that case will be a result of gravity pushing the inserts down and the combination of forces urging them up. Such simple method of assessing the conditions of lowering the insert assembly down and adjusting the size and weight of the successive inserts allows eliminating any uncertainties associated with calculating various forces acting on the inserts. These uncertainties are not easily accounted for and include variations in discharge of gases and various fluids from the well. In embodiments, the inserts may be selected to assure that the positive balance of forces as indicated by the balance 10 should always exceed at least 100 kg. In other embodiments, the safe limit of excess weight on the balance 10 may be selected to be between 100 and 500 kg, or can be assessed as a percentage of the weight of entire flow restricting assembly, such as for example 5-10% of such weight.

The method of the invention may include the following steps:

a. providing a riser extending from a sea surface to end above and in vertical alignment with the oil well;
b. inserting a first flow restricting insert through the riser and into the oil well, the first flow restricting insert is sized to be smaller than the opening of the oil well, thereby reducing the uncontrolled fluid release therefrom;
c. inserting at least one or several additional flow restricting inserts through the riser and into the oil well, thereby further reducing the uncontrolled fluid release from the oil well. These additional inserts may be inserted in parallel or in series with one another. They may also be inserted to be concentric to one another or a combination of these approaches. Inserting additional flow restricting inserts is aimed at reducing the flow of fluid emanating from the oil well to a level suitable for attaching the riser to the oil well, for example not more than 3-5 times that of projected flow from the well under normal operating conditions. At this point the fluid release is generally under control making the next step feasible and safe;

d. sealingly attaching the riser to the oil well to direct all fluid release to flow through the riser to the sea surface, which may be collected by a ship standing nearby or pumped to shore using conventional means. The oil well is now under control and steps can be taken to resume oil production from the oil well through the riser and to the sea surface. Alternatively, the oil well may be sealed such as for example by pumping cement through the riser and into the well.

Figures 2A, 2B, 2C:
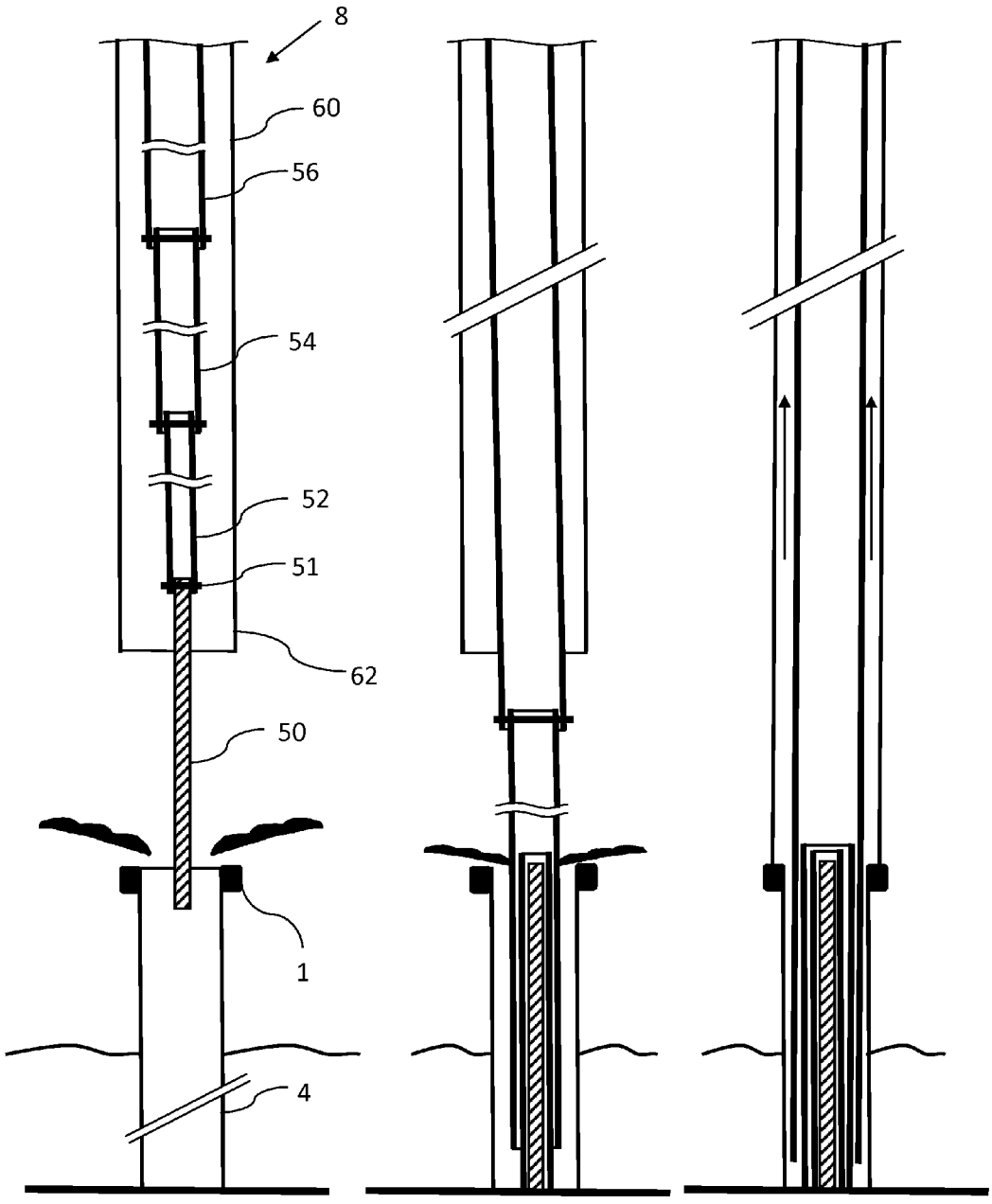
FIGS. 2*a* through 2*d* illustrate various stages of practicing the first embodiment of the method of the invention.
Figure 4A:
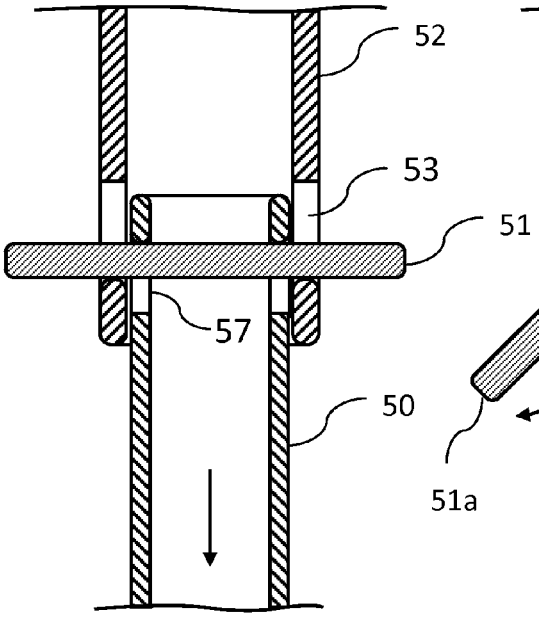
FIGS. 4*a* and 4*b* show the details of attachment between adjacent flow restricting inserts according to the first embodiment of the invention.
Figure 4B:
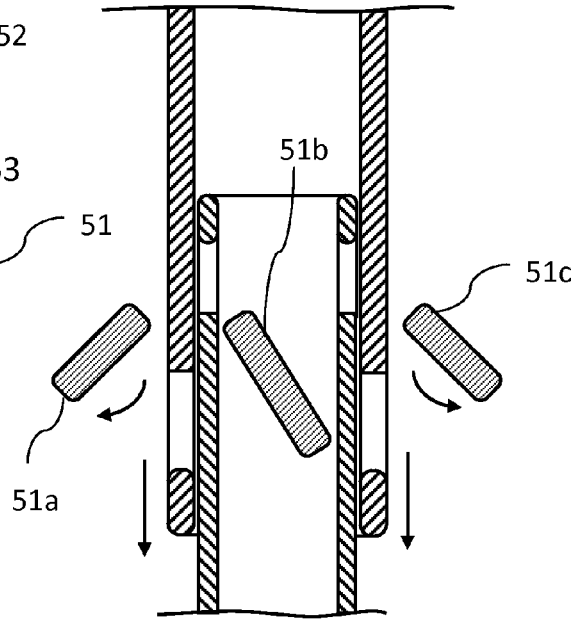
Figure 5A:
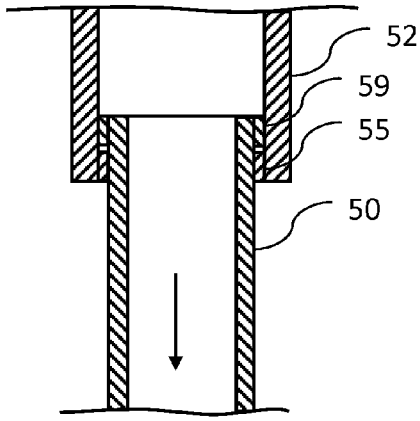
FIGS. 5*a* and 5*b* show the details of attachment between adjacent flow restricting inserts according to the second embodiment of the invention.
Figure 5B:
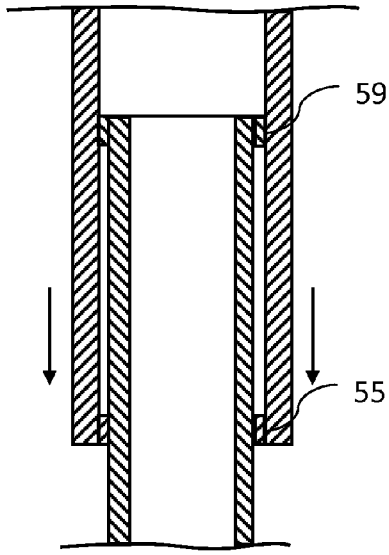

FIGS. 2*a* through 2*d* illustrate an example of the method of the invention according to the first embodiment. Shown in FIG. 2*a* is the beginning of the process of lowering the flow restricting assembly 8 into the well pipe 4 through the lower end 62 of the riser 60 positioned above and aligned with the BOP 1. The flow restricting assembly 8 in this case consists of the first solid insert 50 attached to a higher insert pipe 52, which in turn is attached to a higher and larger insert pipe 54 and finally the assembly 8 includes the upper insert pipe 56. Each successive pipe 52, 54, and 56 may be made to accept the adjacent lower insert inside thereof. The attachments 51 between successive flow restricting inserts may be made to allow hanging of the lower insert at the end of the higher insert respectively. One example of such attachment is shown in FIGS. 4*a* and 4*b*, while another example is shown in FIGS. 5*a* and 5*b* which are discussed in more detail below.

Upon reaching the bottom of the well, the first flow restricting insert 50 stops while the remaining portion of the flow restricting assembly 8 continues its descent into the oil well pipe 4. In embodiments, a connection between the insert 50 and adjacent insert 52 may be made with a cross-bar 51 positioned through the side openings 53 in the insert 52 and a respective side opening 57 in the insert 50. Each of the openings 53 and 55 has a respective lower edge and upper edge. In embodiments, the lower edge of the opening 53 and the upper edge of the opening 57 may be made with rounded edges so as to retain the cross-bar 51 in place without shearing through the cross-bar 51—and therefore supporting hanging the insert 50 off the insert 52—see FIG. 4*a*.

Once the insert 50 stops moving when the well bottom is reached and the insert pipe 52 continues its descent, a relative motion of the insert pipe 52 may be used to disengage it from the insert 50. Due to the upper edge of the opening 53 and the lower edge of the opening 57 having sharp corners, the cross-bar 51 is sheared off into three pieces 51*a*, 51*b*, and 51*c* so that the insert 50 is disconnected from the insert 52—see FIG. 4*b*. FIG. 2*b* shows the inserts 50 and 52 at the bottom of the oil well while the insert 54 is being lowered into the well pipe 4. The attachment between successive inserts may be made in a manner similar to that described above for inserts 50 and 52 such that some or all of the inserts of the flow restricting assembly 8 may be configured to be detached and left in place in the oil well.

FIG. 2*c* shows the stage of the process when all flow restricting inserts are positioned in place and the riser 60 is attached to the remnants of the BOP 1. At this point, the fluid from the oil well pipe 4 is directed through the annular space inside the riser 60 towards the sea surface where it can be collected and transported away from the oil well. In embodiments, at least the largest flow restricting insert 56 may be configured to reach all the way from the bottom of the reservoir to the sea surface so as to allow injecting or withdrawing fluids to or from the oil well.

Figure 2D:
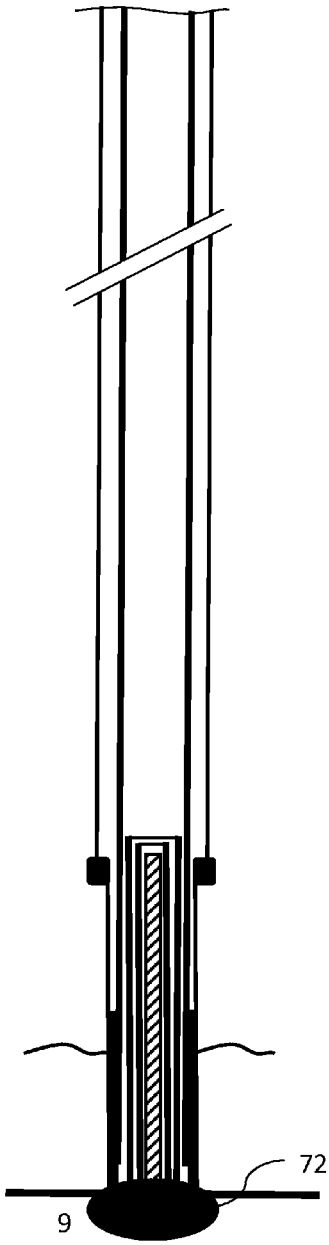

FIG. 2*d* shows a possible disposition of the oil well once uncontrolled fluid release is no longer a problem. In this embodiment, the oil well may be sealed with a cement plug 72 delivered through the annular space between the riser 60 and the largest flow restricting insert 56.

Figure 3A:
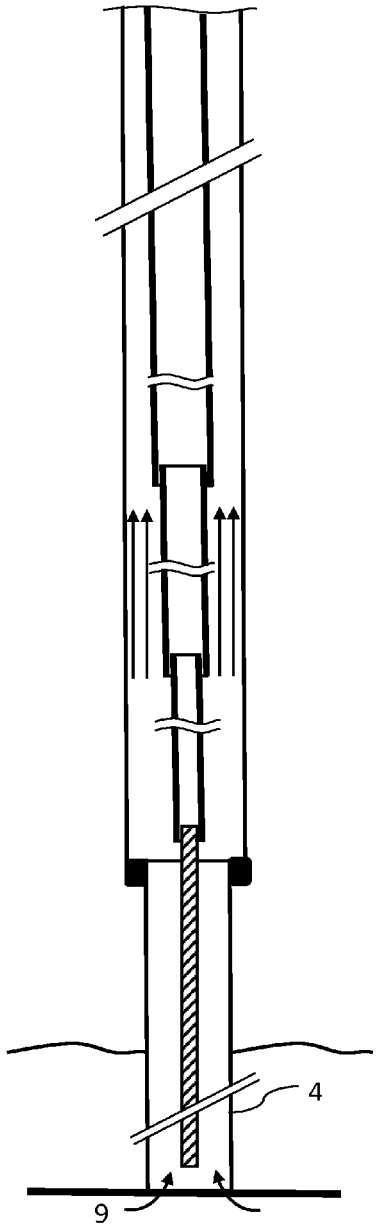
FIGS. 3*a* and 3*b* show various stages of practicing the second embodiment of the invention.
Figure 3B:
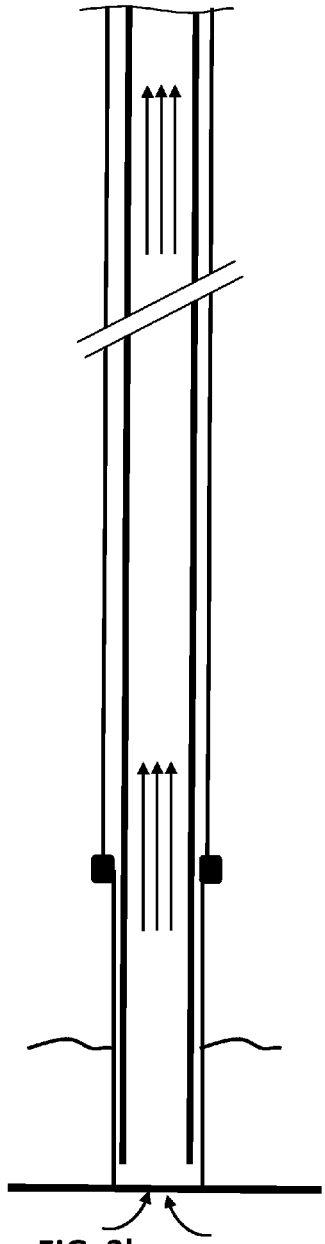

FIGS. 3*a* and 3*b* show another disposition of the oil well according to a second embodiment of the invention, in which individual flow restricting inserts are configured to be engaged and attached to each other allowing the entire assembly to collapse or extend axially like a "spy glass". One such engagement design between adjacent inserts of the flow restricting assembly is shown in FIGS. 5*a* and 5*b*, where each respective portion of flow restricting inserts 50 and 52 has a flange 55 and 59. The flanges 55 and 59 may be configured to overlap each other such that during lowering of the flow restricting assembly 8 into the oil well pipe 4, the lower insert is supported by the adjacent higher insert (as seen in FIG. 5*a*). Upon reaching the bottom of the well, the lower insert 50 may stop and disengage from the next insert 52, which can continue its descent, shown with arrows in FIG. 5*b*. Other possible designs of the ends of respective inserts 50 and 52 may include a bayonet-type design or other fittings that may be engaged and disengaged using mechanical means and motions (such as turning and pulling) as well as hydraulically or electrically-activated coupling means.

One advantage of using coupling means that may be used to reengage adjacent sections of the flow restricting assembly 8 is that after regaining control over the oil well by lowering and axially collapsing the flow restricting assembly 8, oil production may be resumed by lifting the assembly 8 and axially extending flow restricting inserts as seen in FIG. 3*a*. Moreover, periodic lowering or raising of the flow restricting assembly 8 from the sea surface may be used to gradually adjust the flow resistance through the well-riser combination so as to optimize oil production over the remaining life of the oil well when production conditions change over time. The long and tapered flow-restricting assembly 8 allows for fine tuning the resistance of flow over a broad range—from complete flow blockage (full insertion of assembly 8 down the oil well pipe 4) to complete lack of resistance (if the flow restricting assembly 8 is removed from the oil well pipe 4 and the riser 60 altogether).

Figure 5C:
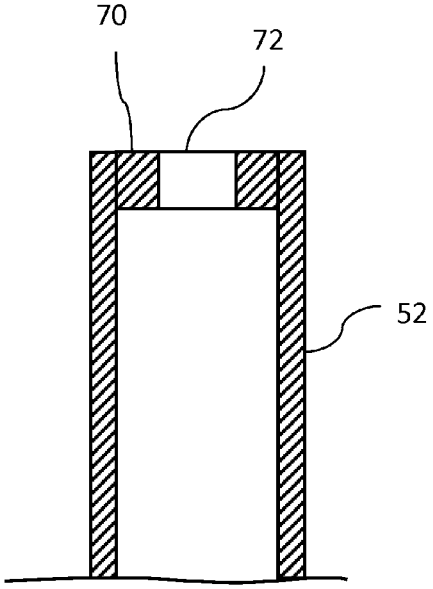
FIGS. 5*c* and 5*d* show the details of the internal stopper at the upper end of the flow restricting inserts of the invention.
Figure 5D:
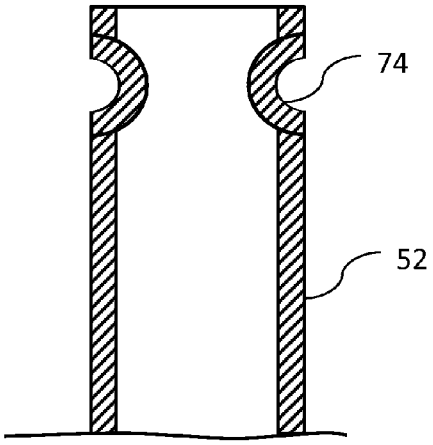

Individual flow restricting inserts may be selected to assure that their own weight may be sufficient to both lower them into the oil well as well as retain them therein. Once the individual inserts of the flow restricting assembly are placed into the oil well, there may be nothing but their own weight which retains them individually in their positions. Alternatively, the upper end of each flow restricting insert may be equipped with an internal stopper 70, see FIG. 5*c*, which may be sized to prevent the adjacent lower insert from slipping up and out therefrom should the oil well pressure exceed the weight of the insert. Since the length of the upper flow restricting insert may be selected to cover the depth of the ocean in addition to the depth of the oil well, the internal stopper in this largest flow restricting insert may be positioned at a location close to the oil well opening—in this case the internal components of the flow restricting assembly will be prevented from moving up on their own and escaping from the oil well. In embodiments, the internal stopper may be a permanent cross-bar, an inner disk 70 with an opening 72 as seen in FIG. 5*c*, an indentation 74 as seen in FIG. 5*d* or another feature, which is configured to prevent the slippage of the internal insert past thereof.

In embodiments, straight individual flow restricting inserts may be used in combination with telescoping combination of flow restricting inserts. In that case, some or all of the telescoping inserts may be removed following restoration of control over the oil well such as oil production may proceed through the larger internal area of the remaining insert—as shown in FIG. 3*b*.

Figure 6:
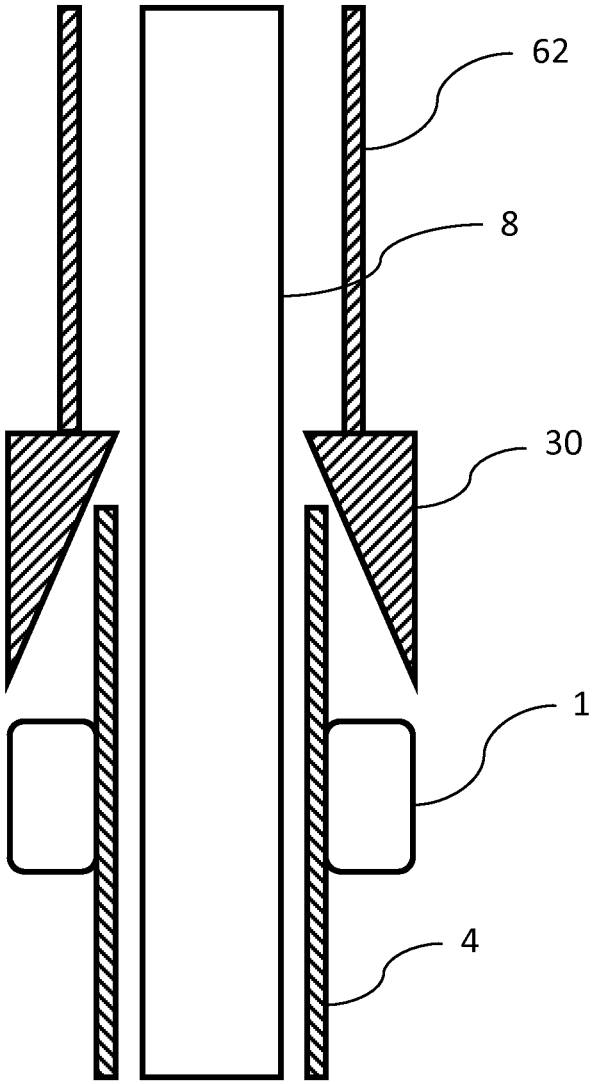
FIG. 6 shows the details of attaching the riser to the oil well.

FIG. 6 shows the details of sealingly attaching the lower end 62 of the riser 60 to the remaining portion of the well pipe 4 and the BOP 1. A tapered fitting 30 may be used to cover the well pipe 4. Once the fitting 30 is placed over the pipe 4, their attachment may be permanently sealed by welding, threaded connection or other known methods.

Figure 7:
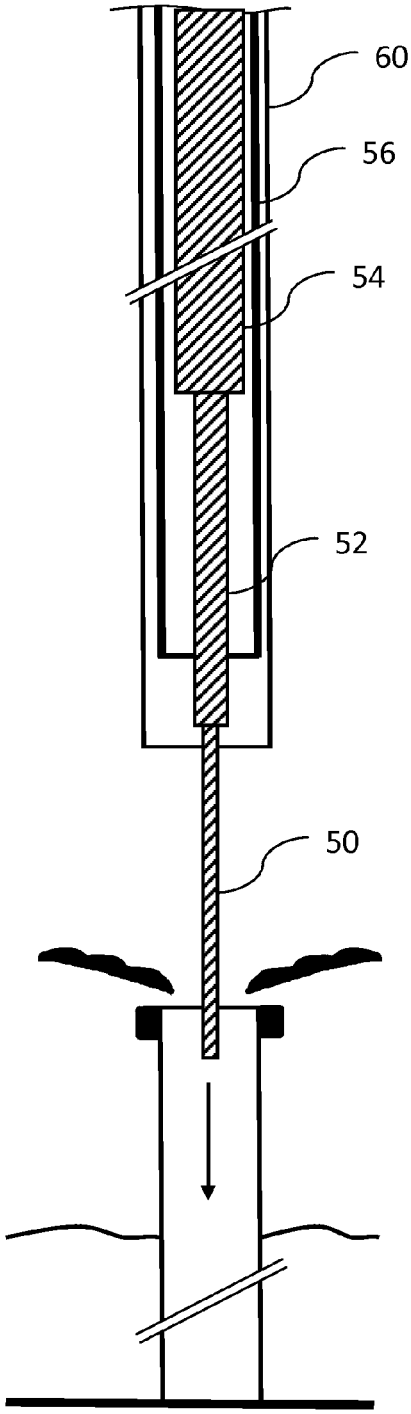
FIG. 7 shows initial steps of the method according to the third embodiment of the invention.

FIG. 7 illustrates a third embodiment of the method of the invention in which a central portion of the flow restricting assembly 8 is made as a telescopic permanent assembly of solid rods of increasing diameters 50, 52, and 54, while the outer portion is made using one or more sliding flow restricting rods 56. In embodiments, once the control over the oil well is regained, the central telescopic rod assembly may be lifted to adjust the flow of oil from the well or removed entirely so that oil production may proceed through the outer insert 56.

FIGS. 8*a* through 8*d* show a fourth embodiment of the method of the invention, in which all flow restricting inserts may be concentric and continuously suspended from the sea surface. In that case, they all may be moved relative to each other and controlled from the sea surface. According to this embodiment, the first flow restricting insert 50 may be initially lowered into the well (see FIG. 8*a*). Once it reaches the bottom of the oil well, a second flow restricting insert 52 may be lowered into the well while sliding over the first insert 50—see FIG. 8*b*. At this stage, the first flow restricting insert 50 may still be suspended from the rig 7 at the sea surface.

Figures 8A, 8B, 8C, 8D:
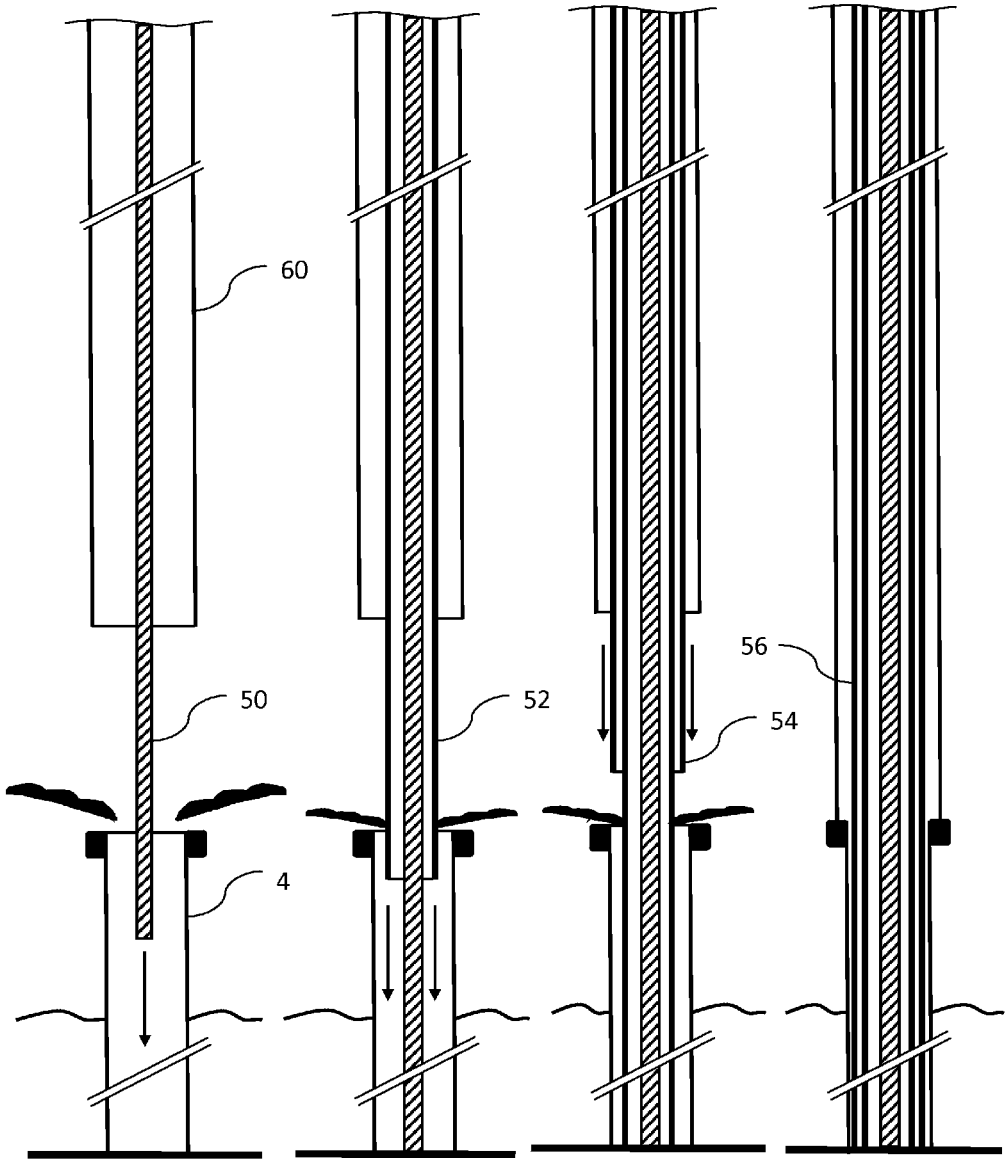
FIGS. 8*a* to 8*e* show various stages of practicing the method according to the fourth embodiment of the invention.
Figure 8E:
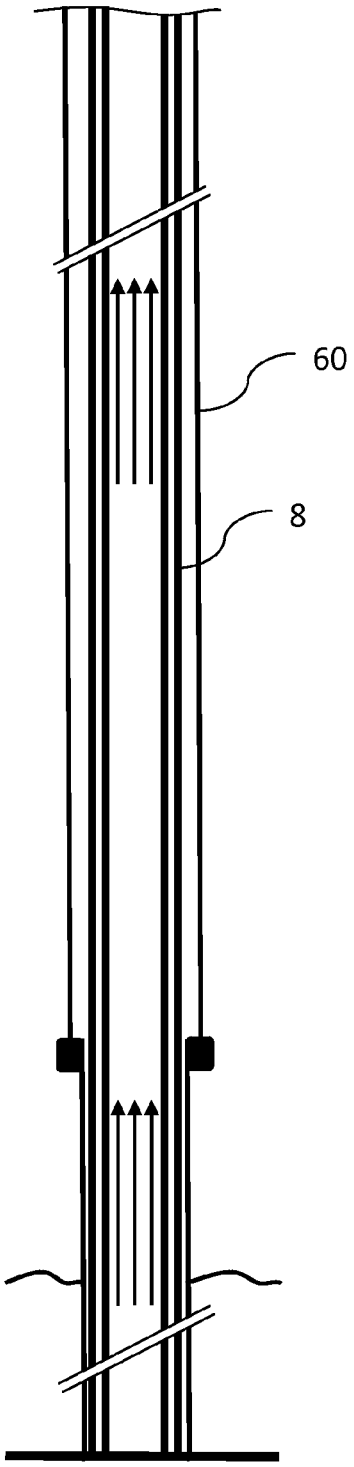

Once the first flow restricting insert 50 and the second flow restricting insert 52 have reached the bottom of the oil well, a third flow restricting insert 54 may be lowered into the oil well while sliding over the insert 52—see FIG. 8*c*. This process may continue until all inserts of the flow restricting assembly 8 are lowered into the oil well so that the riser may be attached to the oil well pipe 4—see FIG. 8*d*. Importantly, at least some or preferably all of the flow restricting inserts are still suspended from the sea surface so as to allow one or more of them to be later (and from time to time) individually lowered, lifted or removed from the oil well as seen in FIG. 8*e*—this is advantageous to allow fine control over the oil flow from the well.

Figure 9A:
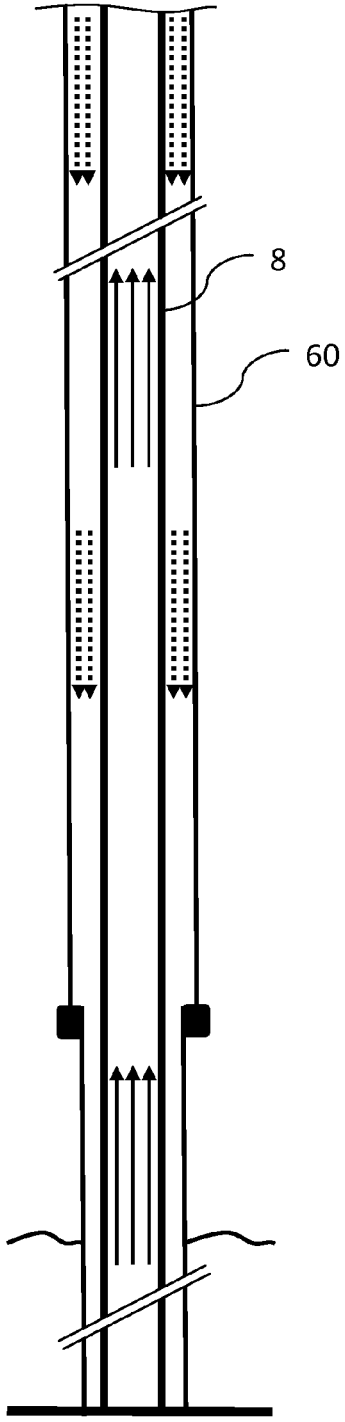
FIGS. 9*a* and 9*b* show various stages of practicing the method according to the fifth embodiment of the present invention.
Figure 9B:
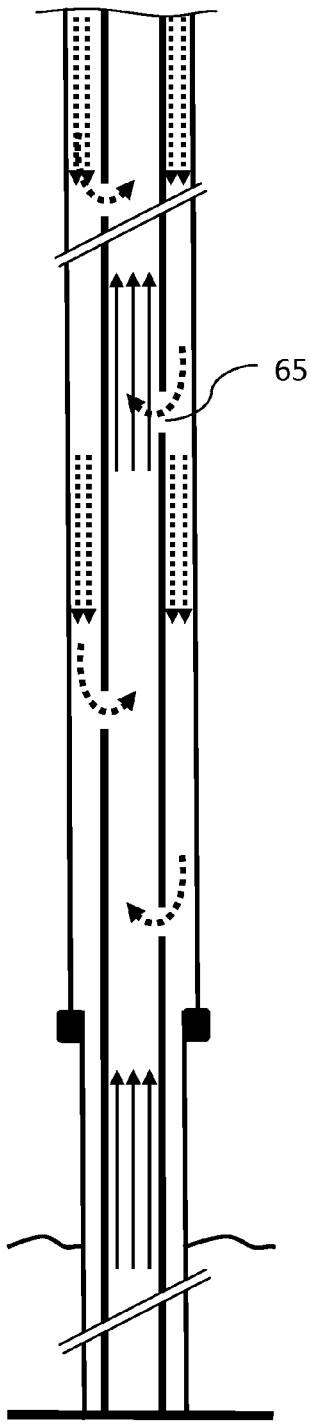

A fifth embodiment of the invention is illustrated in FIGS. 9*a* and 9*b*. In this embodiment, the presence of individually controlled flow restricting inserts after regaining control over the oil well following the explosion may be advantageously used to optimize oil production in future years of the oil well. In particular, it is known that by the end of its useful life, there is a need to boost formation pressure so as to extract more oil therefrom. One technique for doing so is generally known as a gas lift. In this case, gas is injected under pressure into the reservoir to increase the oil flow therefrom.

According to the fifth embodiment of the invention, at least a first passage may be established inside the riser, for example an annular space between the riser and the flow restricting assembly 8. A separate second passage may further be established inside the riser such as for example between individual flow-restricting inserts or by removing one or more of the flow restricting inserts from the riser.

Either the first passage or the second passage may be used for oil production. The other passage may be used to inject gas into the oil well or into the oil producing passage at one or more points along its length.

FIG. 9*a* shows one example of practicing this method of the invention. In this case, gas may be injected in the annular space between the riser 60 and the outer section of the flow restricting assembly 8 (gas flow shown with dashed arrows). Enhanced oil production may be directed through the central opening—as shown with regular arrows.

FIG. 9*b* shows an alternative embodiment of this method of the invention in which the outer section of the flow restricting assembly may contain one or more openings along its length. In this case, injecting gas into the annular space between the riser 60 and the flow restricting assembly 8 will result in forming one or more gas entry points 65 (shown as curved dashed arrows) into the oil producing passage leading to increased production of oil from the oil well.

The herein described subject matter sometimes illustrates different components or elements contained within, or connected with, different other components or elements. It is to be understood that such depicted architectures are merely examples, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Although the invention herein has been described with respect to particular embodiments, it is understood that these embodiments are merely illustrative of the principles and applications of the present invention. For example, the method of the invention may be adapted for oil wells that are not offshore. In that case, flow restricting inserts may be placed into the well from the ground. It is therefore to be understood that numerous modifications may be made to the illustrative embodiments and that other arrangements may be devised without departing from the spirit and scope of the present invention as defined by the appended claims.

We claim:

1. A method for restoring control and resuming production at an offshore oil well following an uncontrolled fluid release after an explosion, said method comprising the steps of:

a. providing a riser extending from a sea surface, said riser ending above and in vertical alignment with an oil well head of the oil well, b. inserting a first flow restricting insert through the riser and into the oil well head, said first flow restricting insert sized to be smaller than the opening of the oil well head, thereby reducing the uncontrolled fluid release therefrom, c. inserting at least one additional flow restricting insert through the riser and into the oil well, thereby further reducing the uncontrolled fluid release from the oil well to a level suitable for attaching the riser to the oil well, and d. sealingly attaching the riser to the oil well head to direct all fluid release to flow through the riser to the sea surface, whereby restoring control of the oil well and resuming oil production therefrom through the riser.

2. The method as in claim 1 further including after step (d) a step of lowering or lifting at least one of said flow restricting inserts to optimize oil production from the oil well through the riser.

3. The method as in claim 2, wherein said step of lowering or lifting at least one of said flow restricting inserts is repeated from time to time to optimize oil production of the oil well throughout its lifetime.

4. The method as in claim 1, wherein at least one of said first or said additional flow restricting inserts is individually suspended from the sea surface so as to allow individual lowering or lifting thereof following completion of step (d).

5. The method as in claim 1, wherein at least one of said first or said additional flow restricting inserts is suspended from or attached to a lower end of a subsequent flow restricting insert to form an assembly of flow restricting inserts, whereby lowering or lifting of said subsequent flow restricting insert from the sea surface causes a corresponding lowering or lifting of said assembly of flow restricting inserts.

6. The method as in claim 5, wherein at least some of said flow restricting inserts are made hollow and sized to slidingly accept inside thereof of other flow restricting inserts below thereof in said assembly of flow restricting inserts, whereby upon lowering of said assembly into said oil well in step (c), said assembly is axially collapsed upon reaching a bottom of said well.

7. The method as in claim 1 further including after step (d) a step of inserting at least one additional flow restricting insert or removing at least one existing flow restricting insert to optimize oil production from the oil well through the riser.

8. The method as in claim 7, wherein said step of inserting or removing at least one of said flow restricting inserts is repeated from time to time to optimize oil production of the oil well throughout its lifetime.

9. The method as in claim 1, wherein in step (c) said fluid release is reduced to a level not exceeding five times a projected oil production rate of the oil well through the riser at the sea surface.

10. The method as in claim 1, wherein in steps (b) and (c) said flow restricting inserts are configured so as to exceed in total weight the forces urging said flow restricting inserts out of the oil well.

11. A method for restoring control at an offshore oil well following an uncontrolled fluid release after an explosion, said method comprising the steps of:

a. providing a riser extending from a sea surface, said riser ending above and in vertical alignment with an oil well head of the oil well, b. inserting through the riser a first flow restricting insert into the oil well head, said first flow restricting insert sized to be smaller than the opening of the oil well head, thereby reducing the uncontrolled fluid release therefrom, c. inserting a plurality of successively larger concentric hollow flow restricting inserts through the riser into the oil well, said plurality of flow restricting inserts sliding over said first flow restricting insert, thereby further reducing the uncontrolled fluid release from the oil well, and d. sealingly attaching the riser to the oil well head, whereby restoring control of the oil well and precluding further uncontrolled fluid release therefrom.

12. The method as in claim 11, further including sealing said oil well with cement pumped through the riser.

13. The method as in claim 11 further including a step of resuming oil production from the oil well through the riser.

14. The method as in claim 11, wherein said plurality of concentric flow restricting inserts comprise a series of individual pipes, each successive pipe is sized to accept a previous pipe inside thereof.

15. The method as in claim 14, wherein at least one of said plurality of individual pipes and said first flow restricting insert is individually suspended from the sea surface to allow further lowering or raising thereof after completion of step (d) to adjust flow resistance from said oil well to the sea surface.

16. The method as in claim 11 further including after step (d) a step of creating a gas lift by forming a first passage from a bottom of the oil well to the sea surface for production of fluids therethrough; said step further including forming a second passage from the sea surface to one or more entry points along the first passage; said step further including injecting gas from the sea surface into said second passage so as to form a gas lift to increase oil production from said oil well.

17. The method as in claim 16, wherein said first or said second passages are formed by removing at least one of said flow restricting inserts from said riser.

18. The method as in claim 16, wherein said first passage is formed by removing said first flow restricting insert from said riser.

19. The method as in claim 16, wherein at least one of said first passage or said second passage is formed in an annular space between said riser and said flow restricting inserts.

20. The method as in claim 19, wherein at least one of said flow restricting inserts comprising at least one opening along said first passage to provide fluid communication between said second passage and said first passage, thereby allowing gas to entry from the second passage into the first passage to create said gas lift.

* * * * *